US009728319B2

(12) United States Patent
Kawashima et al.

(10) Patent No.: US 9,728,319 B2
(45) Date of Patent: Aug. 8, 2017

(54) COIL PART

(71) Applicants: SUMIDA CORPORATION, Chuo-ku, Tokyo (JP); TOYOTA JIDOSHA KABUSHIKI KAISHA, Toyota-shi, Aichi-ken (JP)

(72) Inventors: Hiroshi Kawashima, Miyagi (JP); Jun Muto, Toyota (JP); Takahiro Hirano, Toyota (JP)

(73) Assignee: SUMIDA CORPORATION, Tokyo (JP)

( * ) Notice: Subject to any disclaimer, the term of this patent is extended or adjusted under 35 U.S.C. 154(b) by 87 days.

(21) Appl. No.: 14/496,597

(22) Filed: Sep. 25, 2014

(65) Prior Publication Data

US 2015/0102893 A1 Apr. 16, 2015

(30) Foreign Application Priority Data

Oct. 11, 2013 (JP) ..... 2013-213912

(51) Int. Cl.
*H01F 27/24* (2006.01)
*H01F 27/30* (2006.01)
(Continued)

(52) U.S. Cl.
CPC ..... *H01F 27/2823* (2013.01); *H01F 27/24* (2013.01); *H01F 27/26* (2013.01);
(Continued)

(58) Field of Classification Search
CPC ..... H01F 27/2804; H01F 38/14; H01F 2027/2819; H01F 5/00; H01F 17/0006;
(Continued)

(56) References Cited

U.S. PATENT DOCUMENTS 3,431,144 A * 3/1969 Shiraishi ..... H01F 17/0006 29/602.1
4,622,627 A * 11/1986 Rodriguez ..... H01F 27/022 361/782

(Continued)

FOREIGN PATENT DOCUMENTS

CN 1606106 A 4/2005
JP H07263262 A 10/1995

(Continued)

OTHER PUBLICATIONS

Japanese Notice of Reasons for Rejection for counterpart Application No. JP2013-213912 dated Sep. 29, 2015 with English Translation.

(Continued)

*Primary Examiner* — Alexander Talpalatski
*Assistant Examiner* — Joselito Baisa
(74) *Attorney, Agent, or Firm* — Cantor Colburn LLP

(57) ABSTRACT

There is to provide a coil part capable of reducing the number of fastening means such as screws and so on required when attaching it to a substrate. A coil part includes a transformer unit and a reactor unit, wherein the transformer unit includes: a primary winding part formed by winding a flat wire around a primary side hollow part; secondary winding parts, the secondary winding part being formed by winding a flat wire around a secondary side hollow part communicating with the primary side hollow part, arranged in pairs in a state of facing one side and another side of the primary winding part respectively; and a first core inserted into the primary side hollow part and the secondary side hollow part, and the reactor unit includes: a reactor winding part formed by extending one terminal side of the flat wire constituting the secondary winding part and
(Continued)

winding the flat wire around a reactor side hollow part; and a second core inserted into the reactor side hollow part.

10 Claims, 7 Drawing Sheets

(51) Int. Cl.
*H01F 27/28* (2006.01)
*H01F 30/00* (2006.01)
*H01F 37/00* (2006.01)
*H01F 27/26* (2006.01)

(52) U.S. Cl.
CPC ..... *H01F 27/306* (2013.01); *H01F 30/00* (2013.01); *H01F 37/00* (2013.01)

(58) Field of Classification Search
CPC ..... H01F 5/003; H01L 2924/30107; H01L 23/645; H01L 23/5227; H01L 28/10
USPC ..... 336/212, 220, 221, 222, 223, 198, 208
See application file for complete search history.

(56) References Cited

U.S. PATENT DOCUMENTS 5,331,536 A * 7/1994 Lane ..... H01F 27/2847 336/178
6,114,932 A * 9/2000 Wester ..... H01F 17/0006 336/192
6,504,463 B1 * 1/2003 Kato ..... H01F 27/292 336/192
6,522,233 B1 * 2/2003 Kyoso ..... H01F 27/324 336/192
6,636,140 B2 * 10/2003 Fujiyoshi ..... H01F 30/10 336/192
6,940,387 B2 * 9/2005 Shibata ..... H01F 17/04 29/602.1
6,972,657 B1 * 12/2005 Pacala ..... H01F 27/2866 336/200
7,142,084 B2 * 11/2006 Cheng ..... H01F 27/292 336/200
7,439,839 B2 * 10/2008 Podlisk ..... H01F 5/003 336/200
8,013,709 B2 * 9/2011 Tsai ..... H01F 27/2847 336/119
8,179,222 B2 * 5/2012 Lee ..... H01F 27/2847 336/208
8,400,250 B2 * 3/2013 Nagano ..... H01F 27/263 336/212
8,446,244 B1 * 5/2013 Kuang ..... H01F 27/40 336/220
2007/0047266 A1 3/2007 Nakahori
2007/0176722 A1 * 8/2007 Podlisk ..... H01F 5/003 336/200
2012/0223799 A1 * 9/2012 Hester ..... H01F 27/30 336/220

FOREIGN PATENT DOCUMENTS

JP H09306757 A 11/1997
JP 2002299130 A 10/2002
JP 2007043765 A 2/2007
JP 2007097390 Y 4/2007
JP 2010251364 A 11/2010
JP 2011082205 A 4/2011

OTHER PUBLICATIONS

Chinese Notification of the First Office Action corresponding to Patent No. 20140513230.8; Issue Date Jun. 2, 2016, with English translation.

* cited by examiner

COIL PART

CROSS REFERENCE TO RELATED APPLICATION

This application is based upon and claims the benefit of priority from Japanese patent application No. 2013-213921, filed on Oct. 11, 2013, the disclosure of which is incorporated herein in its entirety by reference.

BACKGROUND OF THE INVENTION

1. Field of the Invention

The present invention relates to a coil part.

2. Description of the Related Art

Patent Document 1 discloses, for example, a configuration in which coil parts having different functions are attached on the same base plate. Patent Document 1 discloses a configuration in which a main transformer and a choke coil are attached on the same base plates, respectively.

[Patent Document 1] Patent document 1: Japanese Patent Application Laid-Open No. 2010-251364 (see FIG. 11 and so on)

Incidentally, in the configuration of Patent Document 1, parts using coils such as the main transformer and the choke coil are separately attached via fastening means such as screws, bolts and so on. Therefore, the number of fastening means required when attaching them is large, and accordingly the man-hour for attachment is also large therewith.

Further, in an environment that vibration is applied, the fastening means may loosen in use for a long period. Therefore, in the case of attaching the parts using coils such as the main transformer and the choke coil, a smaller number of the fastening means is more preferable. In the configuration of Patent Document 1, however, the parts using coils are separately and individually attached, so that there is a limit in reducing the number of fastening means.

The present invention has been made in consideration of the problem, and its object is to provide a coil part capable of reducing the number of fastening means such as screws and so on required when attaching it to a substrate.

SUMMARY OF THE INVENTION

To solve the above problem, an aspect of a coil part of the present invention is a coil part including a transformer unit and a reactor unit. The transformer unit includes a primary winding part and secondary winding parts. The primary winding parts are formed by winding a flat wire around a primary side hollow part. The secondary winding part is formed by winding flat wires around secondary side hollow parts communicating with the primary side hollow part, arranged in pairs in a state of facing one side and another side of the primary winding part respectively. And a first core inserted into the primary side hollow part and the secondary side hollow part. And the reactor unit includes a reactor winding part and a second core. The reactor winding part is formed by extending one terminal side of the flat wire constituting the secondary winding part and winding the flat wire around a reactor side hollow part. And the second core is inserted into the reactor side hollow part.

Further, in another aspect of the coil part of the present invention, it is preferable, in addition to the above-described invention, that the second core is composed of two core members butted each other via a magnetic gap member.

Furthermore, in another aspect of the coil part of the present invention, it is preferable, in addition to the above-described invention, that the secondary winding part is made by winding a plurality of the flat wires adjacent to each other, and the reactor winding parts is also made by winding the plurality of the flat wires adjacent to each other.

Further, in another aspect of the coil part of the present invention, it is preferable, in addition to the above-described invention, that at least one of the primary winding part and the secondary winding part has a region where on an outer peripheral side of a winding part with a small diameter, a winding part with a diameter larger than the winding part with a small diameter is arranged adjacent thereto.

Furthermore, in another aspect of the coil part of the present invention, it is preferable, in addition to the above-described invention, that a first magnetic path formed by the first core and a second magnetic path formed by the second core are provided to be almost parallel or almost perpendicular to each other.

Further, in another aspect of the coil part of the present invention, it is preferable, in addition to the above-described invention, that the first magnetic path and the second magnetic path are provided to be almost perpendicular to each other. The first core is constituted by two E-shaped cores butted each other, the E-shaped core being made by erecting outer legs at both ends of a columnar coupling base part respectively and erecting a middle leg between both the outer legs, and the butting is implemented in a state where the middle leg is inserted into the primary side hollow part and the secondary side hollow part. And the second core is constituted by two U-shaped cores butted each other, the U-shaped core including a coupling part and a pair of outer legs coupled to the coupling part and opposite each other, and the butting is implemented in a state where one of the outer legs is inserted into the reactor side hollow part and another of the outer legs is located on a side away from the first core.

Further, another aspect of a coil part of the present invention is a coil part including a first winding structure formed of a flat wire and a second winding structure formed of a flat wire. The first winding structure includes a first winding part formed by winding the flat wire around a first hollow part, a second winding part formed by winding the flat wire around a second hollow part, and a connecting wire part connecting the first winding part and the second winding part and composed of the flat wire. The first winding part is used as a secondary winding part of a transformer unit, the second winding part is arranged around a reactor side hollow part and used as a reactor winding part of a reactor unit. The secondary winding part and the reactor winding part are capable of forming different magnetic paths respectively. The second winding structure includes a third winding part formed by winding the flat wire around a third hollow part, the third winding part is arranged around a primary side hollow part and used as a primary winding part of the transformer unit. A pair of the first winding parts are provided, the third winding part is located between the pair of the first winding parts, the first winding parts and the third winding part are arranged in a superposed state, and a first core is inserted into the first hollow part in the superposed state, and the first core is further inserted into the third hollow part.

Further, in another aspect of the coil part of the present invention, it is preferable, in addition to the above-described invention, that at least one of the primary winding part, the secondary winding part, and the reactor winding part is formed by edgewise-winding.

According to the present invention, it becomes possible to reduce, in a coil part, the number of fastening means such as screws and so on required when attaching it to a substrate.

DETAILED DESCRIPTION OF THE PREFERRED EMBODIMENT

Figure 1:
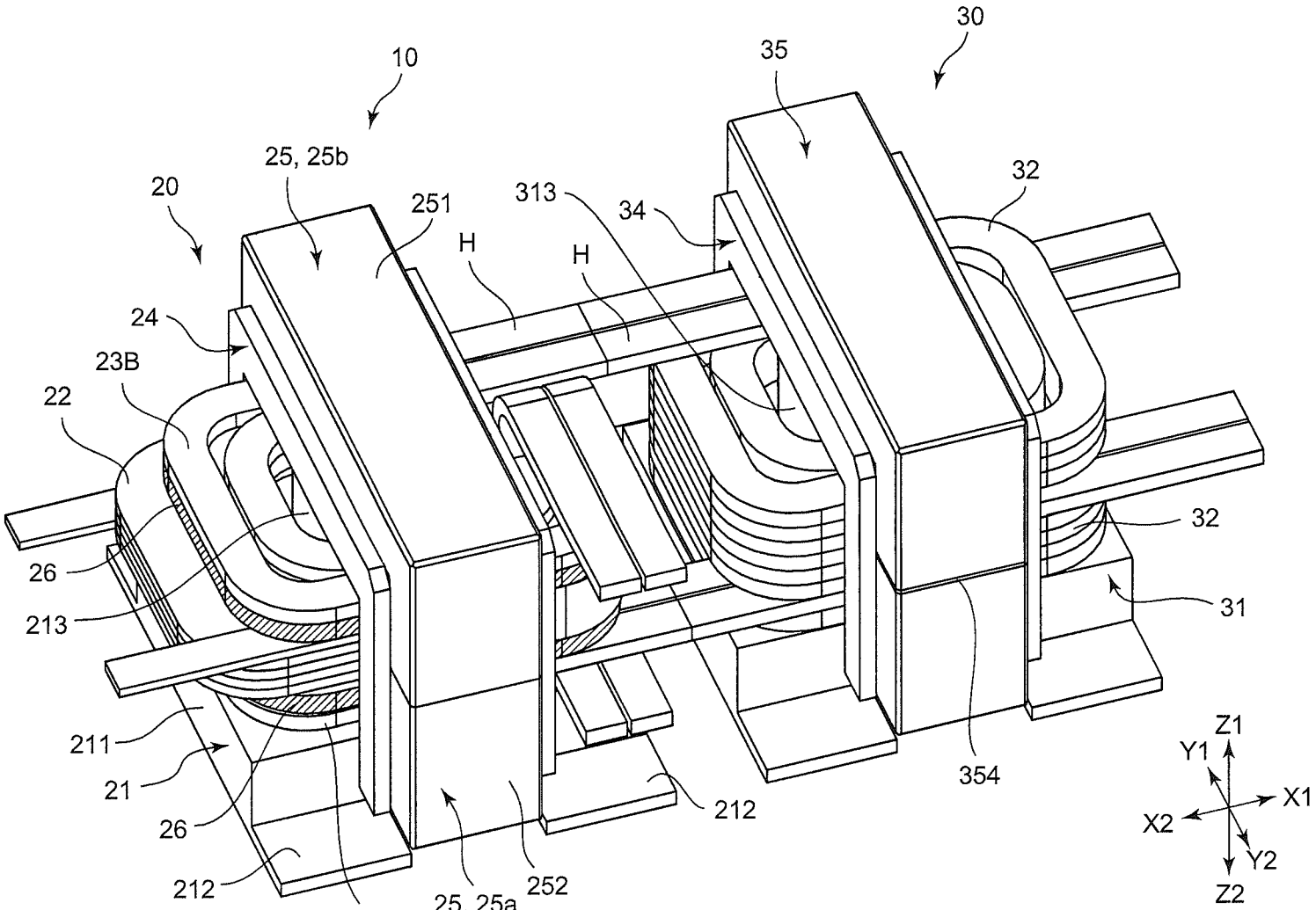
FIG. 1 is a perspective view illustrating a configuration of a coil part according to one embodiment of the present invention.

Hereinafter, a coil part 10 according to one embodiment of the present invention will be described based on the drawings.

Note that in the following description, it is assumed that an extending direction of a later-described hollow support part 213 is a vertical direction (Z-direction), the side where an upper positioning part 241 of a cover 24 is located in the vertical direction (Z-direction) is an upper side (Z1 side), and the side opposite thereto where leg parts 212 of a base 21 are located is a lower side (Z2 side). It is further assumed that a direction in which a transformer unit 20 and a reactor unit 30 are arranged side by side is an X-direction, the side where the reactor unit 30 is located with respect to the transformer unit 20 is an X1 side, and the side opposite thereto is an X2 side. It is further assumed that a direction perpendicular to the X-direction and the Z-direction is a Y-direction, and the back side in FIG. 1 is a Y1 side and the front side opposite thereto is a Y2 side.

<Regarding Configuration of Coil Part 10>

FIG. 1 is a perspective view illustrating a configuration of the coil part 10. As illustrated in FIG. 1, the coil part 10 includes the transformer unit 20 and the reactor unit 30. The transformer unit 20 includes the base 21, a primary winding part 22, secondary winding parts 23A, 23B, the cover 24, and E-shaped cores 25.

Figure 2:
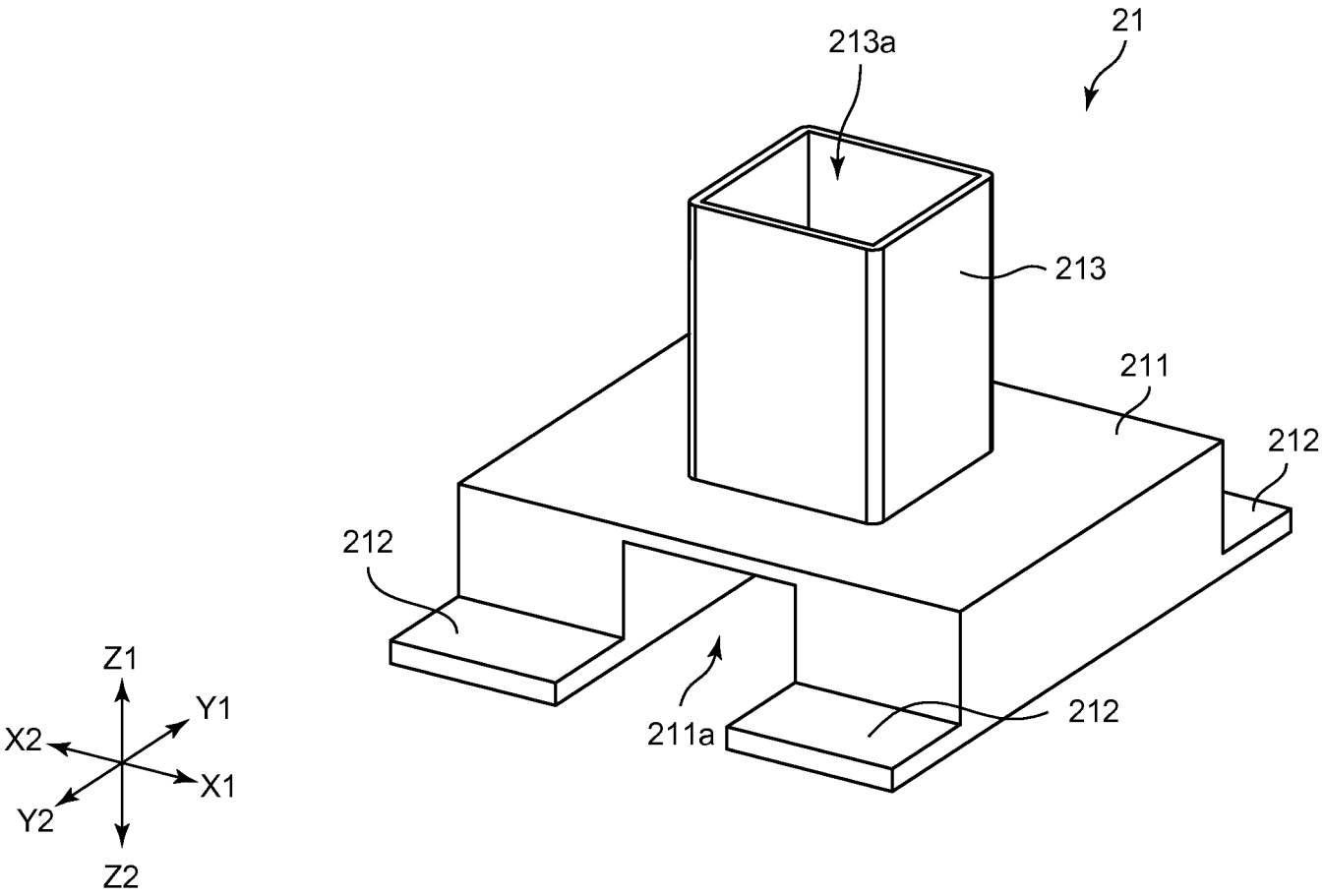
FIG. 2 is a perspective view illustrating a configuration of a base of the coil part in FIG. 1.

FIG. 2 is a perspective view illustrating a configuration of the base 21. The base 21 is a part that supports members of the transformer unit 20. The base 21 includes a pedestal part 211, the leg parts 212, and the hollow support part 213. The pedestal part 211 is a part on which the secondary winding part 23A is mounted. However, for the base 21, a configuration in which the secondary winding part 23A is directly mounted thereon is not employed, but a configuration in which the secondary winding part 23A is mounted thereon via another member such as a spacer or the like. In this embodiment, the pedestal part 211 has a planar shape provided in a rectangular shape, and a through hole (not illustrated) communicating with the hollow support part 213 provided on the center side of the rectangular shape.

On the lower side (Z2 side) of the pedestal part 211, the leg parts 212 are provided. The leg parts 212 are provided to protrude further in the Y-direction than does the pedestal part 211 in order to enhance the stability of the base 21. In this embodiment, the leg parts 212 are provided at four corners of the pedestal part 211, respectively.

Note that in this embodiment, in a side view of the base 21, a fitting recessed portion 211*a* is provided on the lower side (Z2 side) of the hollow support part 213 in the pedestal part 211, and the E-shaped core 25 (E-shaped core 25*a*) is fitted in the fitting recessed portion 211*a*. Further, the interval between the leg parts 212 in the X-direction is provided to be almost the same as the fitting recessed portion 211*a*.

From the pedestal part 211, the hollow support part 213 extends toward the vertical direction (Z-direction). The hollow support part 213 is a support post part in a hollow shape. In a hollow portion 213*a* of the hollow support part 213, middle legs 253 of the pair of E-shaped cores 25 are arranged. Further, on the outer peripheral side of the hollow support part 213, the secondary winding part 23A, the primary winding part 22, and the secondary winding part 23B are arranged in this order from the lower side (Z2 side) toward the upper side (Z1 side). Note that insulating members 26 are arranged between the secondary winding part 23A and the primary winding part 22 and between the primary winding part 22 and the secondary winding part 23B, respectively.

As illustrated in FIG. 1, the secondary winding part 23A is mounted on the pedestal part 211. The secondary winding part 23A is formed by alpha-winding and edgewise-winding a flat wire H a predetermined times. At this time, a secondary side hollow part (not illustrated) existing on the inner peripheral side of a winding part is located on the outer peripheral side of the hollow support part 213. In this embodiment, the secondary winding part 23A is wound in a state that two flat wires H are arranged side by side (laterally) in an XY plane. This increases the surface area of a conductive part, thereby enabling the secondary winding part 23A to deal with the skin effect.

However, the secondary winding part 23A does not need to be composed of the two flat wires H wound in a state where they are laterally arranged side by side but may be composed of only one flat wire H or composed of three or more flat wires H wound in a state where they are laterally arranged side by side. Alternatively, two or more flat wires H may be wound in a state where they are not laterally arranged side by side but arranged one on top of another in the vertical direction.

One end side of the terminal of the flat wire H constituting the secondary winding part 23A does not protrude toward the reactor unit 30, but protrudes in a direction different from the secondary winding part 23A and is connected (not illustrated) to one end side of the terminal of the secondary winding part 23B. On the other hand, the other end side of the terminal of the flat wire H constituting the secondary winding part 23A extends toward the reactor unit 30 side. Then, as will be described later, the other end side of the secondary winding part 23A continues to a reactor winding part 32 of the reactor unit 30.

As illustrated in FIG. 1, on the upper side (Z1 side) of the secondary winding part 23A, the primary winding part 22 is mounted via the insulating member 26. The primary winding part 22 is also formed by alpha-winding and edgewise-winding a flat wire H a predetermined times. At this time, a primary side hollow part (not illustrated) existing on the inner peripheral side of a winding part is located on the outer peripheral side of the hollow support part 213.

The primary winding part 22 constitutes a transformer together with the secondary winding parts 23A, 23B, and mutual induction is performed between them. To this end, the primary winding part 22 is formed by winding the flat wire H a desired number of windings according to the mutual induction. Note that the primary winding part 22 is a winding structure (second winding structure; not illustrated) different from a later-described first winding structure 100 (see FIG. 5), and a third winding part in the second winding structure is used as the primary winding part 22 of the transformer unit 20. Note that the above-described primary side hollow part corresponds to a third hollow part.

As illustrated in FIG. 1, on the upper side (Z1 side) of the primary winding part 22, the secondary winding part 23B is mounted via the insulating member 26. The secondary winding part 23B is formed to have the same number of windings as that of the above-described secondary winding part 23A. Further, the direction of the winding of the secondary winding part 23B is the direction of the winding to generate a magnetic field in the same direction as that of the secondary winding part 23A. By inserting the hollow support part 213 into the secondary side hollow parts of the secondary winding parts 23B, 23A and the primary side hollow part of the primary winding part 22, central portions of the winding parts of the secondary winding parts 23A, 23B and the primary winding part 22 coincide with each other. However, their central portions may be slightly displaced from each other.

Note that the secondary winding part 23B is wound in a state where two flat wires H are arranged side by side in the XY plane (laterally arranged), as in the above-described secondary winding part 23A. However, the secondary winding part 23B may be composed of only one flat wire H, may be composed of three or more flat wires H wound in a state where they are laterally arranged side by side, or may be composed of two or more flat wires H wound in a state where they are not laterally arranged side by side but arranged one on top of another in the vertical direction.

Figure 3:
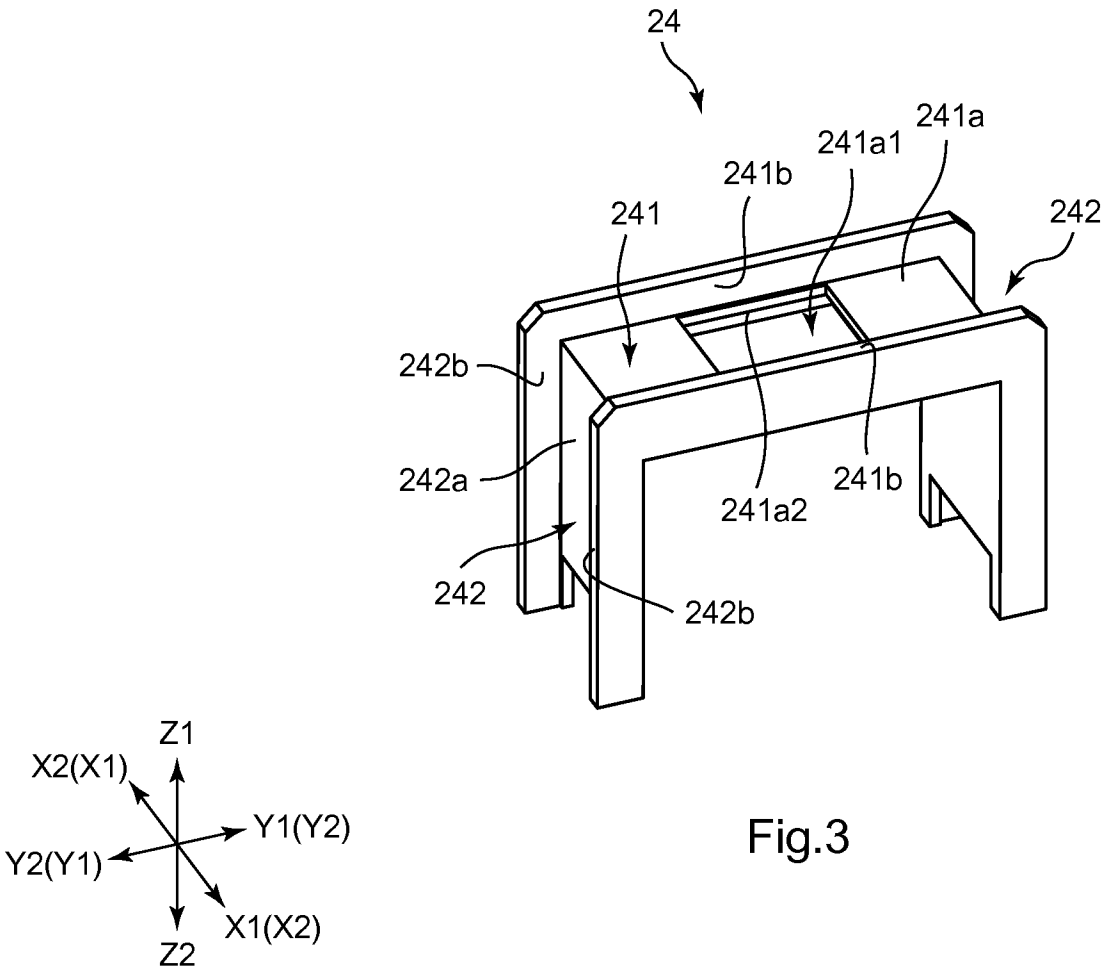
FIG. 3 is a perspective view illustrating a configuration of a cover of the coil part in FIG. 1.
Figure 4:
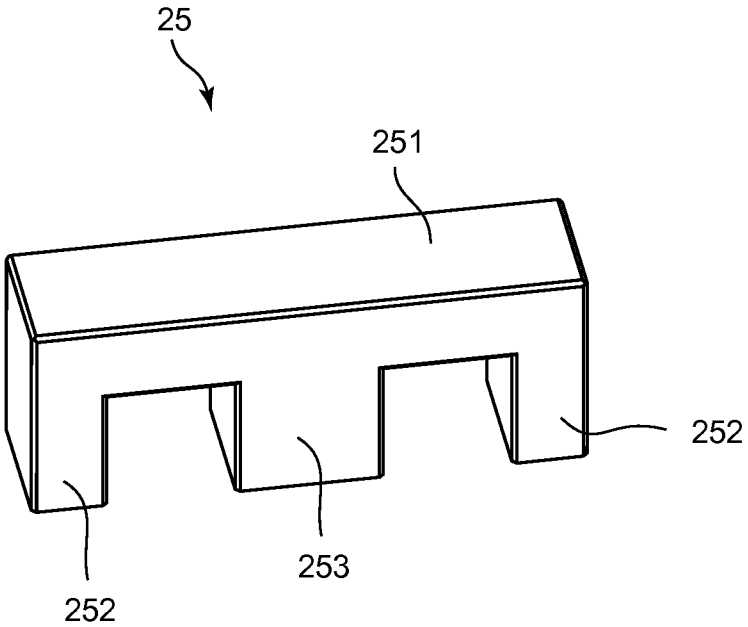
FIG. 4 is a perspective view illustrating a configuration of an E-shaped core of the coil part in FIG. 1.

As illustrated in FIG. 3, the cover 24 is a member for attaching the E-shaped core 25 to the base 21, and the cover 24 is therefor provided in a manner to cover a part on the upper side (Z1 side) of the secondary winding parts 23B and provided in a manner to cover parts on the outer peripheral side of the primary winding part 22 and the secondary winding parts 23A, 23B. Further, the cover 24 is a member for insulating the E-shaped cores 25 from the primary winding part 22 and the secondary winding parts 23A, 23B. The cover 24 is formed in a shape corresponding to the shape of the E-shaped cores 25. Therefore, in a side view, the cover 24 is provided to form an almost C-shape.

The cover 24 is provided with the upper positioning part 241 and side positioning parts 242. The upper positioning part 241 is located on the upper side (Z1 side) of the secondary winding part 23B, for positioning a coupling base part 251 of the E-shaped core 25. In order to perform the positioning, the upper positioning part 241 is provided with a bottom plate portion 241*a*. From both sides in the width direction of the bottom plate portion 241*a*, a pair of flange portions 241*b* are erected upward, and the interval between the pair of flange portions 241*b* corresponds to the coupling base part 251. This positions the coupling base part 251.

At a center in the longitudinal direction of the bottom plate portion 241*a*, a through hole 241*a*1 is provided. The through hole 241*a*1 is a hole for allowing the middle leg 253 of the E-shaped core 25 to pass therethrough. Here, on the lower surface side of the bottom plate portion 241*a*, the through hole 241*a*1 is provided in a stepped shape. Namely, a stepped portion 241*a*2 is provided around the through hole 241*a*1 on the lower surface side of the bottom plate portion 241*a*. The stepped portion 241*a*2 is a portion that receives the upper edge side of the hollow support part 213 and restricts its further movement to the upper side (Z1 side). Therefore, the through hole 241*a*1 is formed such that its opening area is smaller on the upper side (Z1 side) of the stepped surface of the stepped portion 241*a*2 than on the lower side (Z2 side).

From both ends in the longitudinal direction of the upper positioning part 241, the side positioning parts 242 extend to the lower side (Z2 side) respectively. The side positioning parts 242 are parts that position the outer legs 252 of the E-shaped core 25. Therefore, the side positioning part 242 has, similarly to the upper positioning part 241, a bottom plate portion 242*a* and a pair of flange portions 242*b*.

The E-shaped core 25 is formed of a magnetic material such as a ferrite, amorphous, or silicon steel plate. The E-shaped core 25 is a core of a type made by respectively erecting the outer legs 252 on both ends of the columnar coupling base part 251 and erecting the middle leg 253 between both the outer legs 252. A pair of the E-shaped cores 25 are provided and arranged so that their outer legs 252 and middle legs 253 are butted each other. In the following description, the E-shaped core 25 located on the lower side (Z2 side) of the pair of E-shaped cores 25 is called an E-shaped core 25*a* and the E-shaped core 25 located on the upper side (Z1 side) is called an E-shaped core 25*b*. Note that the E-shaped core 25 corresponds to a first core. However, the pair of butted E-shaped cores 25 may correspond to the first core.

The middle leg 253 of the E-shaped core 25*a* on the lower side (Z2 side) is inserted into the hollow portion 213*a* of the hollow support part 213, and the coupling base part 251 is fitted into the fitting recessed portion 211*a*. At this time, both end sides of the coupling base part 251 of the E-shaped core 25*a* extend outward from the fitting recessed portion 211*a*. Therefore, the outer legs 252 fall out of the fitting recessed portion 211*a*, are located between the pair of leg parts 212, and extend to the upper side (Z1 side) therefrom.

Further, the middle leg 253 of the E-shaped core 25*b* on the upper side (Z1 side) is inserted into the hollow portion 213*a* of the hollow support part 213, and the coupling base part 251 is fitted into the upper positioning part 241. Further, the outer legs 252 are fitted into the side positioning parts 242 respectively. Here, the E-shaped core 25*a* on the lower side (Z2 side) and the E-shaped core 25*b* on the upper side (Z1 side) are arranged such that their middle legs 253 are butted each other and their outer legs 252 are also butted each other.

Next, the reactor unit 30 will be described. The reactor unit 30 includes a base 31, a cover 34, and E-shaped cores 35 similar to those of the above-described transformer unit 20. Accordingly, these will be described only about different portions and the description of the other will be omitted.

On the other hand, the reactor unit 30 is different in the reactor winding part 32. The reactor winding part 32 is formed to achieve a desired L by winding the flat wires H extending respectively from the secondary winding parts 23A, 23B.

Figure 5:
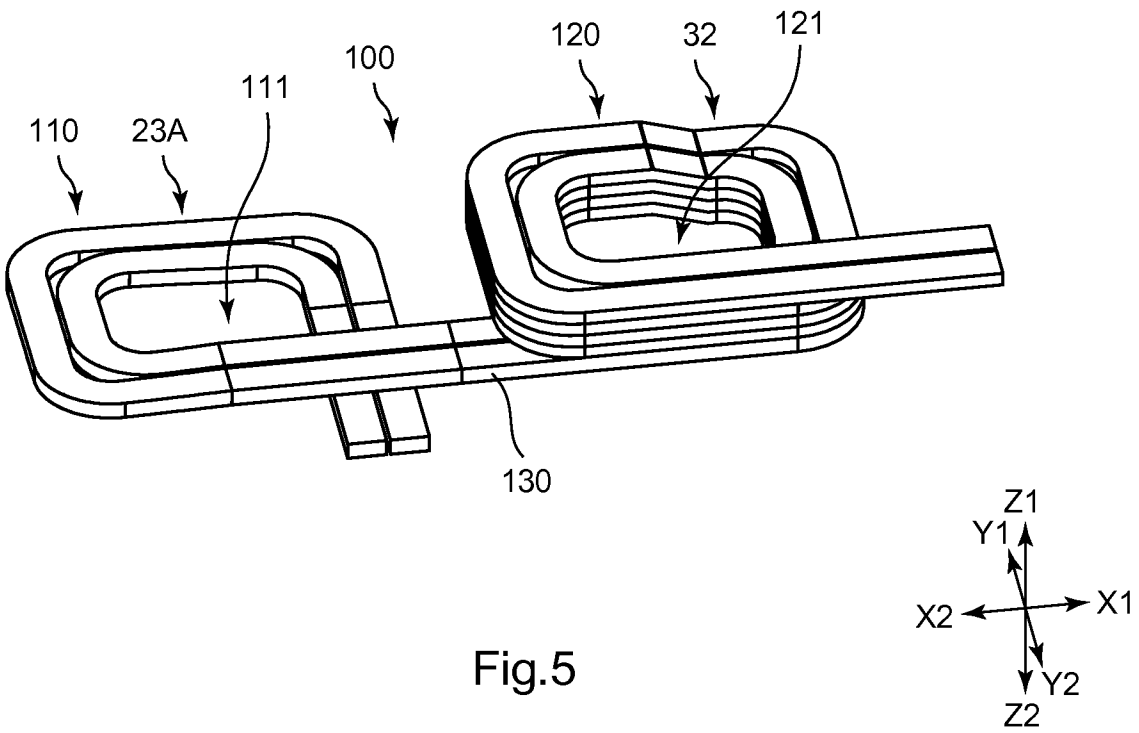
FIG. 5 is a perspective view illustrating a configuration of a first winding structure in which a reactor winding part and a secondary winding part are integrated together.

In this embodiment, when winding the flat wires H for forming a winding part, the flat wires are not cut between the secondary winding parts 23 (23A, 23B) and the reactor winding part 32 but they are integrally formed. This state is illustrated in FIG. 5. FIG. 5 is a perspective view illustrating a configuration of the first winding structure 100 in which the reactor winding part 32 and the secondary winding part 23A are integrated together. Note that in FIG. 5, two flat wires H are in a state to be adjacent to each other and may be regarded as corresponding to the first winding structure 100, but a structure formed by winding only one flat wire H may be regarded as corresponding to the first winding structure 100.

As illustrated in FIG. 5, the reactor winding part 32 is provided integrally with the secondary winding part 23A, and the integral configuration corresponds to the first winding structure 100. Here, the first winding structure 100 includes two winding parts such as a first winding part 110 formed by winding the flat wires H around a first hollow part 111 and a second winding part 120 formed by winding the flat wires H around a second hollow part 121, which can form separate magnetic paths respectively. The first winding structure 100 further includes a connecting wire part 130 that connects the first winding part 110 and the second winding part 120. The first winding part 110 of them is used as the secondary winding part 23A and the second winding part 120 is used as the reactor winding part 32.

Note that a configuration in which the secondary winding part 23B and the reactor winding part 32 are integrally provided is the same as that in FIG. 5, and this configuration also corresponds to the first winding structure 100. Further, the first hollow part 111 corresponds to the secondary side hollow part in the secondary winding part 23A, 23B and the second hollow part 121 corresponds to the reactor side hollow part of the reactor winding part 32.

The reactor winding part 32 is also formed by alpha-winding and edgewise-winding a flat wire H a predetermined times. At this time, the reactor side hollow part (not illustrated) existing on the inner peripheral side of the winding part is located on the outer peripheral side of a hollow support part 313 of the base 31. Note that both of the pair of reactor winding parts 32 have directions of the windings to generate magnetic fields in the same direction. Further, the pair of reactor winding parts 32 are preferably formed in the same number of windings but may be different in the number of windings.

Further, a pair of E-shaped cores 35 are butted each other, and there is a magnetic gap member 354 formed of a non-magnetic material at a butting region between them. Namely, the magnetic gap member 354 exists at the butting region between their outer legs 352 and at the butting region between their middle legs 353, thereby suppressing magnetic saturation.

Note that the E-shaped core 35 corresponds to a second core, but the pair of E-shaped cores 35 butted each other via the magnetic gap member 354 may correspond to the second core. Further, each of the E-shaped cores 35 may be regarded as corresponding to a core member. Further, the E-shaped core 35 may be made of the same material as that of the E-shaped core 25, but may be made of a different material to achieve a desired L inductance. Further, the E-shaped core 35 may be different in size and shape from the E-shaped core 25.

Figure 6:
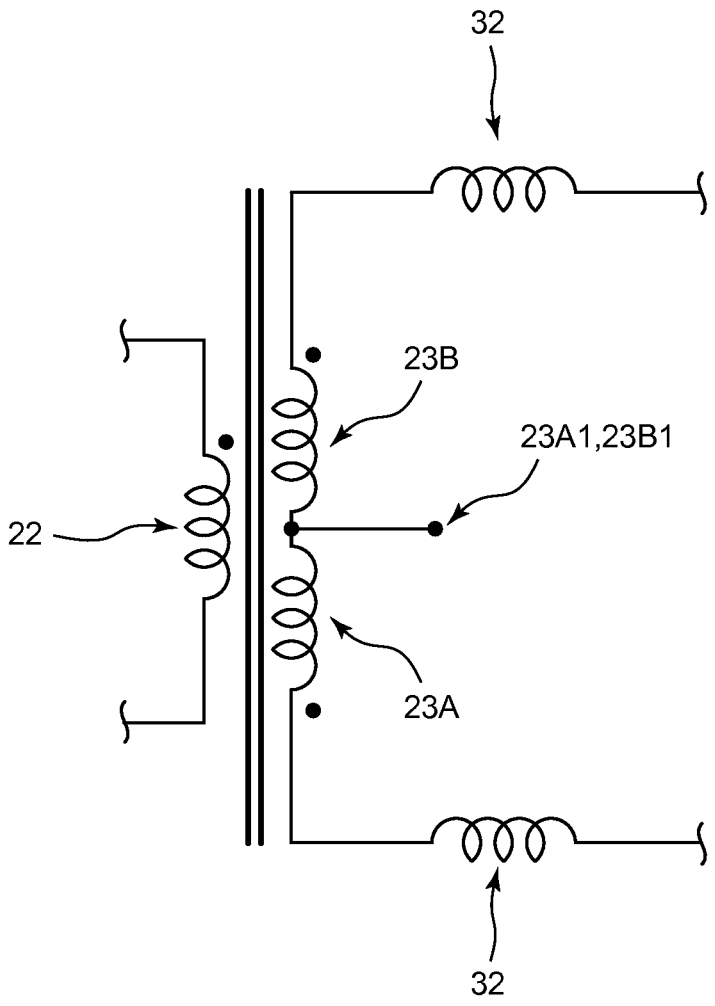
FIG. 6 is a diagram illustrating an example of an electric circuit using the coil part in FIG. 1.

Here, an example of a partial electric circuit using the coil part 10 illustrated in FIG. 1 is illustrated in FIG. 6. As illustrated in FIG. 6, the pair of secondary winding parts 23A, 23B are arranged in a state of facing the primary winding part 22. Note that in FIG. 6, the secondary winding part 23A and the secondary winding part 23B are connected to each other by intermediate taps 23A1, 23B1. The terminals of the secondary winding parts 23A, 23B on the opposite side to the terminals extending to the reactor winding parts 32 side correspond to the intermediate taps 23A1, 23B1. Further, the reactor winding parts 32 are connected to the secondary winding parts 23A, 23B, respectively.

In FIG. 6, when an alternating current is conducted to the primary winding part 22, a magnetic path (corresponding to a first magnetic path) is formed between the pair of E-shaped cores 25, and the magnetic path excites the secondary winding parts 23A,23B. Then, the current conducted through the pair of secondary winding parts 23A,23B is also conducted to the pair of reactor winding parts 32. This forms a magnetic path (corresponding to a second magnetic path) between the E-shaped cores 35.

Note that the secondary winding part 23A and the secondary winding part 23B are connected to each other by the intermediate taps 23A1, 23B1 in the configuration illustrated in FIG. 6, but the secondary winding part 23A and the secondary winding part 23B may be separately and independently configured without such connection, so that current in separate systems may be conducted thereto.

<Effects>

In the coil part 10 with the above-described configuration, the reactor winding part 32 is integrally formed by extending one terminal side of the secondary winding part 23A, 23B. Integrating the transformer unit 20 and the reactor unit 30 as described above eliminates separate and independent attachment of the transformer unit 20 and the reactor unit 30 when the transformer unit 20 and the reactor unit 30 are attached to a mounting board. This makes it possible to reduce the number of fastening means such as screws, bolts and so on. Further, the reduction in number of the fastening means such as screws, bolts and so on also makes it possible to reduce the man-hour for attaching the fastening means.

Further, in the case of using the fastening means such as screws, bolts and so on, the fastening means may loosen due to the use for a long period. In particular, in an environment that vibration is applied such as various vehicles, a part of many fastening means may loosen. However, since the number of fastening means in use can be reduced in this embodiment, it becomes possible to decrease the possibility of causing the loosening of the fastening means.

Further, in this embodiment, the pair of E-shaped cores 35 are butted each other via the magnetic gap member 354. This makes it possible to suppress generation of magnetic saturation in the E-shaped cores 35.

Further, in this embodiment, the secondary winding part 23A, 23B are made by winding a plurality of (two in FIG. 1) the flat wires adjacent to each other, and the reactor winding parts 32 are also made by winding a plurality of (two in FIG. 1) the flat wires adjacent to each other. This increases the surface area of a conductive part of the flat wire H, thereby enabling them to deal with the skin effect when a high-frequency current is conducted.

Further, in this embodiment, the magnetic path (first magnetic path) formed by the pair of E-shaped cores 25 and the magnetic path (second magnetic path) formed by the pair of E-shaped cores 35 are provided almost in parallel. Therefore, a predetermined space can be provided between the pair of E-shaped cores 25 and the pair of E-shaped cores 35, thereby reducing mutual influence between the first magnetic path and the second magnetic path. Further, the longitudinal direction of the pair of E-shaped cores 25 and the longitudinal direction of the pair of E-shaped cores 35 are arranged almost in parallel, thereby making it possible to downsize the coil part 10 as a whole.

Further, in this embodiment, the first winding structure 100 formed by winding the flat wire H includes the first winding part 110 formed into the secondary winding part 23A, 23B, the second winding part 120 formed into the reactor winding part 32, and the connecting wire part 130 connecting them. In addition, in the second winding structure formed by winding the flat wire H, the winding part (third winding part) is used as the primary winding part 22 of the transformer unit 20. Therefore, in the first winding structure 100, integrating the winding parts such as the secondary winding part 23A, 23B and the reactor winding part 32 with the connecting wire part 130 that connects them and conducts current, eliminates the conductive part on the mounting board side, thereby making it possible to downsize the whole unit including the coil part 10.

Further, in this embodiment, each of the primary winding part 22, the secondary winding parts 23A, 23B, and the reactor winding parts 32 is formed by edgewise-winding. Therefore, in each winding part, the shape in the winding state can be kept by edgewise bending. Further, in the case of using the flat wire H, the cross-sectional area of the conductive part can be made larger than the case of winding a round wire. It is also possible to decrease the floating capacity when conducting a high-frequency current.

Modification Examples

One embodiment of the present invention has been described above, but the present invention is variously modified other than that. Hereinafter, those will be described.

In the above embodiment, a plurality of (two in FIG. 1) flat wires H are wound to be adjacent to each other. However, they may be configured as follows. Namely, one flat wire H may have an arrangement that a winding pattern of one turn with a large inner diameter, the one with a middle inner diameter, and the one with a small inner diameter may be stacked in this order. In this case, parts of the winding patterns with different inner diameters are made to exist within the same plane, thereby making it possible to suppress the height of the winding part of the flat wire H. Note that the winding part may be any of the primary winding part 22, the secondary winding parts 23A, 23B, and the reactor winding parts 32. Further, the kinds of the inner diameter of the winding pattern of one turn are not limited to three kinds such as the large one, the middle one, and the small one, but may be two kinds or four or more kinds.

Further, in the above embodiment, both of the primary winding part 22 and the secondary winding part 23A, 23B are wound such that a plurality of (two in FIG. 1) flat wires H are adjacent to each other. However, only the primary winding part 22 is wound such that a plurality of (two in FIG. 1) flat wires H are adjacent to each other, or only the secondary winding part 23A, 23B is wound such that a plurality of (two in FIG. 1) flat wires H are adjacent to each other.

Further, the configuration in which the magnetic path (first magnetic path) formed by the pair of E-shaped cores 25 and the magnetic path (second magnetic path) formed by the pair of E-shaped cores 35 are provided almost in parallel is described in the above embodiment. However, a configuration in which the first magnetic path and the second magnetic path are almost perpendicular to each other may be employed. In this case, not the E-shaped core but a U-shaped core may be used for at least one of the first core and the second core.

Figure 7:
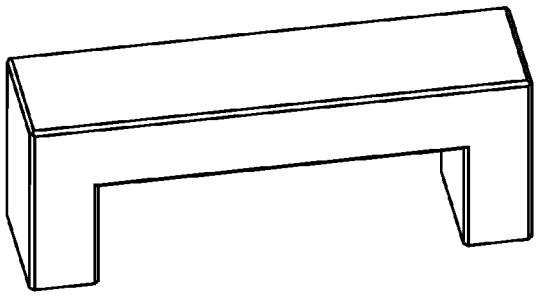
FIG. 7 is a perspective view illustrating a configuration of a U-shaped core of the coil part in FIG. 1.

Referring to FIG. 7, the U-shaped core is a core having a pair of legs and a coupling part coupling the pair of legs so that the shape in a plan view is a U-shape. In the case of using the U-shape core, it is possible to make the following arrangement. For example, the longitudinal direction of the E-shaped core (direction in which the outer legs are arranged) is parallel to the Y-direction, and the direction in which the leg parts of the U-shaped core is along the X-direction. In addition, one of the leg parts of the U-shaped core is inserted into the hollow part of the winding part, and the other leg part of the U-shaped core is arranged at a position away from the E-shaped core. This arrangement makes a state where the most of the first magnetic path exists within a YZ plane and the most of the second magnetic path exists in an XZ plane. Therefore, it becomes possible to reduce the interference between the first magnetic path and the second magnetic path while narrowing the interval between the transformer unit and the reactor unit adjacent to each other.

Further, in the above embodiment, each of the primary winding part 22, the secondary winding parts 23A, 23B, and the reactor winding parts 32 is formed by edgewise-winding the flat wire H. However, all of the primary winding part 22, the secondary winding parts 23A, 23B, and the reactor winding parts 32 do not need to be formed by edgewise-winding, but at least one of them may be formed by edgewise-winding.

What is claimed is:

1. A coil part comprising:

a transformer unit and a reactor unit, wherein the transformer unit comprises:

a primary winding part formed by winding a flat wire around a primary side hollow part;

secondary winding parts, the secondary winding part being formed by winding a flat wire around a secondary side hollow part communicating with the primary side hollow part, arranged in pairs in a state of facing one side and another side of the primary winding part respectively; and a first core inserted into the primary side hollow part and the secondary side hollow part, and the reactor unit comprises:

a reactor winding part formed by extending one terminal side of the flat wire constituting the secondary winding part and winding the flat wire around a reactor side hollow part; and a second core inserted into the reactor side hollow part, wherein the transformer unit and the reactor unit are each supported by a base and a cover;

the base is provided with a pedestal part, and a hollow support part extending from the pedestal part and inserted to the primary side hollow part or the secondary side hollow part;

the cover is provided with an upper positioning part having a stepped portion receiving the hollow support part and positioning at least a part of the first core or a part of the second core, and a side positioning part extending from both ends in the longitudinal direction of the upper positioning part and positioning at least a part of the first core or a part of the second core which opposes the hollow support part;

the primary winding part and the secondary winding parts of the transformer unit, or the reactor winding part of the reactor unit, penetrates through a space surrounded by the pedestal part, the hollow support part, the upper positioning part and the side positioning part.

2. The coil part according to claim 1, wherein the second core is composed of two core members butted each other via a magnetic gap member.

3. The coil part according to claim 2, wherein at least one of the primary winding part and the secondary winding part has a region where on an outer peripheral side of a winding part with a small diameter, a winding part with a diameter larger than the winding part with a small diameter is arranged adjacent thereto.

4. The coil part according to claim 1, wherein the secondary winding part is made by winding a plurality of the flat wires adjacent to each other, and the reactor winding part is also made by winding the plurality of the flat wires adjacent to each other.

5. The coil part according to claim 2, wherein the secondary winding part is made by winding a plurality of the flat wires adjacent to each other, and the reactor winding part is also made by winding the plurality of the flat wires adjacent to each other.

6. The coil part according to claim 1, wherein at least one of the primary winding part and the secondary winding part has a region where on an outer peripheral side of a winding part with a small diameter, a winding part with a diameter larger than the winding part with a small diameter is arranged adjacent thereto.

7. The coil part according to any one of claim 1, wherein a first magnetic path formed by the first core and a second magnetic path formed by the second core are provided to be almost parallel or almost perpendicular to each other.

8. The coil part according to claim 7, wherein the first magnetic path and the second magnetic path are provided to be almost perpendicular to each other, the first core is constituted by two E-shaped cores butted each other, the E-shaped core being made by erecting outer legs at both ends of a columnar coupling base part respectively and erecting a middle leg between both the outer legs, and the butting is implemented in a state where the middle leg is inserted into the primary side hollow part and the secondary side hollow part, and the second core is constituted by two U-shaped cores butted each other, the U-shaped core comprising a coupling part and a pair of outer legs coupled to the coupling part and opposite each other, and the butting is implemented in a state where one of the outer legs is inserted into the reactor side hollow part and another of the outer legs is located on a side away from the first core.

9. The coil part according to claim 1, wherein at least one of the primary winding part, the secondary winding part, and the reactor winding part is formed by edgewise-winding.

10. The coil part according to claim 1, wherein the first core is formed by abutting a pair of first E-shaped cores, and the first E-shaped core is provided with a first coupling base part, first outer legs erecting from both ends of the first coupling base part, and a first middle leg erecting between the first outer legs of the first coupling base part;

the second core is formed by abutting a pair of second E-shaped cores, and the second E-shaped core is provided with a second coupling base part and second outer legs erecting from both ends of the second coupling base part and second middle leg erecting from between the second outer legs of the second coupling base part;

the hollow support part supports the middle leg;

the upper positioning part positions the coupling base part, and the side positioning parts position the outer legs; and the upper positioning part is provided with a through hole into which the middle leg passes from a side of the upper positioning part, and the stepped portion is provided around the through hole at the side from which the hollow support part passes.

* * * * *